United States Patent [19]

Sheldon

[11] Patent Number: 4,560,065

[45] Date of Patent: Dec. 24, 1985

[54] CARTON STABILIZER

[75] Inventor: Jerome F. Sheldon, Milwaukee, Wis.

[73] Assignee: Jerome F. Sheldon Inc., West Allis, Wis.

[21] Appl. No.: 637,845

[22] Filed: Aug. 6, 1984

[51] Int. Cl.[4] ..... B65D 65/00

[52] U.S. Cl. ..... 206/427; 206/821; 220/85 R; 220/69

[58] Field of Search ..... 206/427, 216, 821, 449, 206/45.11; 220/69, 62, 85 R

[56] References Cited

U.S. PATENT DOCUMENTS

| | | | |
|---|---|---|---|
| 1,541,416 | 6/1925 | Ingvoldstad | 220/62 |
| 1,685,125 | 9/1928 | Einson . | |
| 1,857,231 | 5/1932 | Allen | 206/45.11 |
| 2,063,328 | 12/1936 | Morcom | 220/69 |
| 2,280,537 | 4/1942 | Murphy | 220/69 |
| 2,554,018 | 5/1951 | Despres | 220/85 R |
| 2,593,998 | 4/1952 | Dupuis | 206/821 |
| 2,643,046 | 6/1953 | Humphreys . | |
| 2,869,769 | 1/1959 | Robinson | 206/216 |
| 3,146,505 | 9/1964 | Hansen | 206/821 |
| 3,209,941 | 10/1965 | Krake | 206/449 |
| 3,297,196 | 1/1967 | Cornelius . | |
| 3,344,734 | 10/1967 | Aguirre et al. | 220/85 R |

*Primary Examiner*—Joseph Man-Fu Moy
*Attorney, Agent, or Firm*—Theresa F. Camoriano

[57] ABSTRACT

A carton stabilizing device including a top web, a bottom web, first and second side webs, and two tabs projecting downward from said top web.

9 Claims, 9 Drawing Figures

CARTON STABILIZER

BACKGROUND OF THE INVENTION

This invention relates generally to cartons, and, more specifically, to a device for stabilizing open-top cartons.

Many types of open-top cartons are known in the art, for example, six-packs and eight-packs for carrying soda and beer. When these cartons are delivered to the store, they are carried in groups or in larger, sturdier containers, giving them stability so they do not tip over. However, when they are purchased by the consumer, individually or in small quantities, they are relatively unstable and may tend to tip over while being conveyed to the consumer's home. The present invention provides a simple device which the consumer may use to increase the stability of one or more cartons so as to greatly reduce the likelihood that they will tip over. The present invention also may carry trademarks, logos, or other markings so as to serve as a form of advertising for the manufacturer of the soda or other type of product which is carried in the carton. The advertising feature of this device is important, because it provides a method for advertising a given brand of product even when the consumer does not have any of the product on hand and even when the consumer is using the device to stabilize a different brand of product.

Some devices have been used in the past for stabilizing cartons. For example, U.S. Pat. No. 3,146,505 "Hansen" describes a clip for holding cartons together to increase their stability. This clip would do nothing to increase the stability of a single carton, and, because it is carried entirely inside the cartons, would not be useful as an advertising device.

BRIEF DESCRIPTION OF THE DRAWINGS

In the accompanying drawings forming a part of this specification, and in which reference numerals shown in the drawings designate like or corresponding parts throughout the same.

DESCRIPTION OF THE PREFERRED EMBODIMENTS

Figure 1:
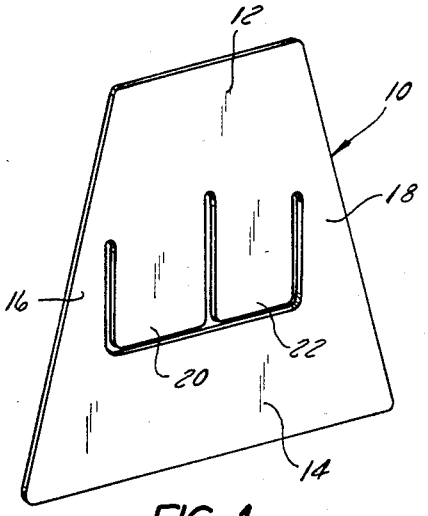
FIG. 1 is a perspective view of a first embodiment of the present invention.
Figure 3:
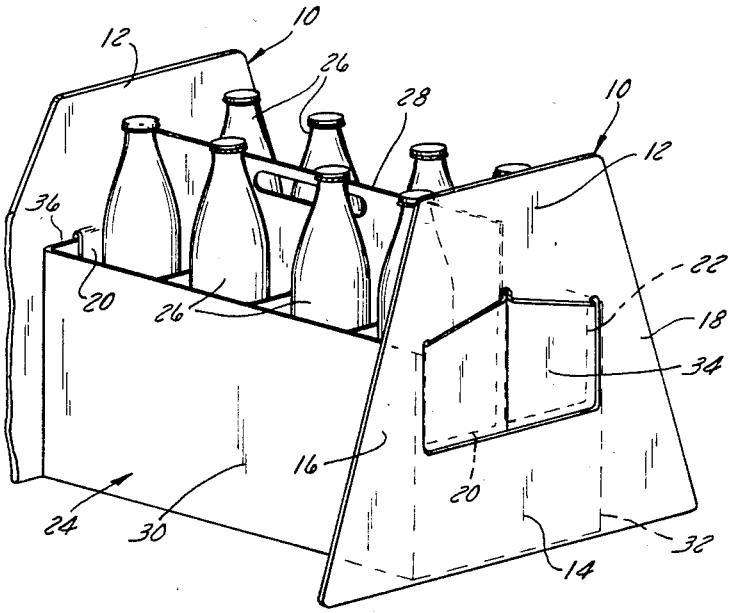
FIG. 3 is a perspective view partially broken away of a carton on which are mounted two of the devices shown in FIG. 1.
Figure 5:
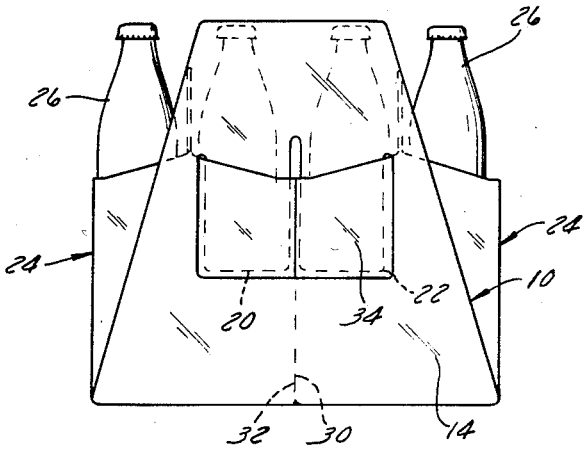
FIG. 5 is an end view of two cartons on which is mounted one of the devices shown in FIG. 1.

FIGS. 1, 3, and 5 show the first embodiment of the present invention. The stabilizer 10 is a substantially flat member which includes a top web portion 12, a bottom web portion 14, first and second side web portions 16 and 18, respectively, and first and second tabs 20 and 22, respectively. This stabilizer 10 may be cut from a flat piece of plastic, metal, or other suitable material, and is therefore relatively inexpensive to manufacture.

The carton 24 holds eight bottles 26 and includes a center panel 28, two side panels, 30, 32, and first and second end panels 34 and 36, respectively.

The tabs 20, 22 of the stabilizer 10 project downward from the top web 12 and lie between the first and second side web portions 16, 18. The bottom web 14 is wider than the width of the end panel 34 of the carton and rests on the same supporting surface (not shown) as does the carton. The width of this bottom web 14 gives the carton a larger base, thereby increasing the stability of the carton against tipping. It is preferred that the width of the bottom web be up to twice the width of the carton; a greater width makes the stabilizer bulky and does not add enough stability to the carton to justify the greater bulk.

This stabilizer 10 tapers so that the top web 12 is narrower than the bottom web 14, thereby making the stabilizer 10 easier to handle. The height of the stabilizer 10 is greater than the height of the end panels 34, 36. The top and bottom webs 12, 14 are connected to each other by means of the side webs 16, 18, and the tabs 20, 22 lie between the side webs 16, 18.

A single stabilizer 10 may be used on one end of the carton 24, or two stabilizers 10 may be mounted on the first and second ends 34, 36 as shown in FIG. 3. The stabilizers 10 are mounted on their respective end panels 34, 36 simply by slipping the tabs 20, 22 into the open top of the carton 24 and downward until the bottom web 14 rests on the same supporting surface (not shown) as does the carton 24 and contacts the outer surface of its respective end panel 34 or 36. When the stabilizer 10 is properly installed as shown herein, the tabs 20, 22 contact the inner surface of the respective end panel 34 or 36 and straddle the center panel 28. By straddling the center panel 28, the tabs 20, 22 fasten the stabilizer 10 to the carton more securely than if there were only a single tab. The tabs 20, 22 should be long enough and wide enough that they do not rotate out of the carton when the carton shifts from side to side.

The top web 12 lies above its respective end panel 34 or 36. All the web portions 12, 14, 16 and 18 lie outside of the carton 24, and the stabilizer 10 is designed so that sufficient area is provided in these web portions for imprinting a company logo or other advertising materials large enough to be read from a distance.

Figure 2:
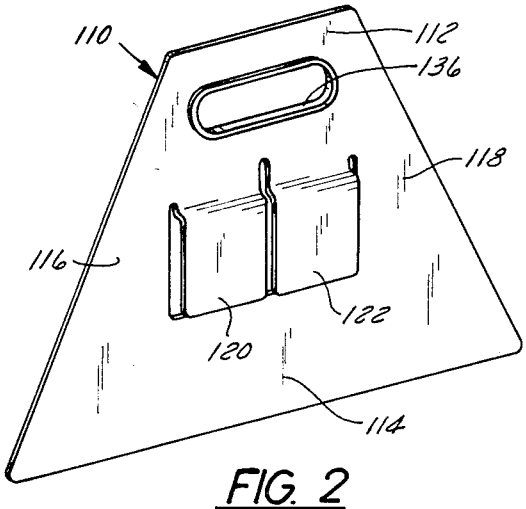
FIG. 2 is a perspective view of a second embodiment of the present invention.
Figure 4:
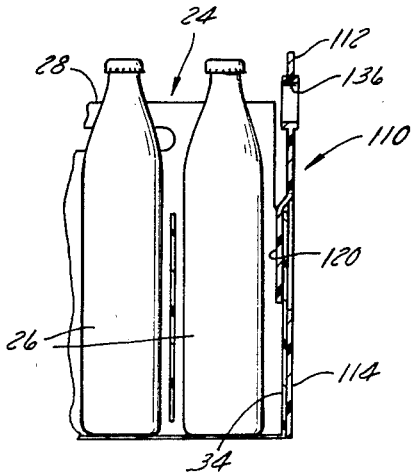
FIG. 4 is a side sectional view partially broken away of a carton on which is mounted one of the devices shown in FIG. 2.

FIGS. 2 and 4 show an embodiment of the invention which is molded or formed from a suitable material. The stabilizer 110 also includes a top web 112, bottom web 114, first and second side webs 116, 118, and two tabs 120, 122. In this embodiment, the tabs 120, 122 are bent out of the plane of the webs so as to facilitate insertion of the tabs into the carton 24. Whereas the tabs 20, 22 of the previous embodiment had to flex slightly to enter into the carton, the tabs 120, 122 of this embodiment do not have to flex. This also means that the stabilizer 110 of this embodiment may be made out of a more rigid material, which may provide more stability. This second embodiment also includes a handle 136 formed in the top web 112. This handle 136 may be used for carrying the stabilizers 110 or for hanging them up when not in use.

Figure 9:
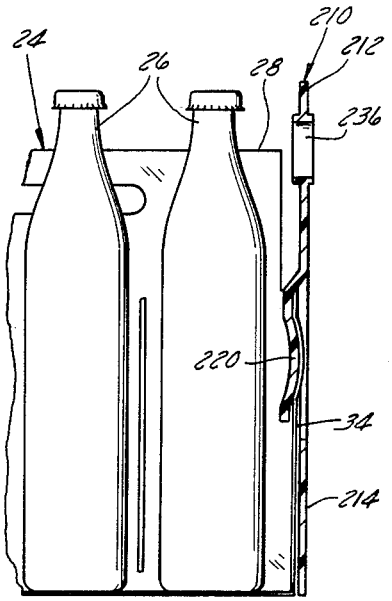
FIG. 9 is a side sectional view partially broken away of a carton on which is mounted a fourth embodiment of the present invention.

The embodiment of the invention shown in FIG. 9 is similar to that in FIGS. 2 and 4, except the tabs 220, 222 have a different shape. The tabs 220, 222 are bent out of the plane of the webs 212, 214, 216, and 218 for ease of insertion. However, these tabs 220, 222 bend back again toward that plane, giving them an undulated cross-section, so that they grip the respective end panel 34 or 36 of the carton 24 for a more secure retention on the carton 24.

Figure 6:
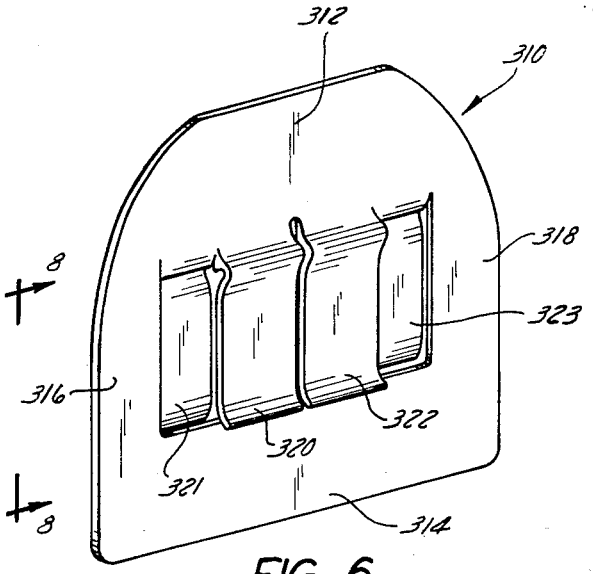
FIG. 6 is a perspective view of a third embodiment of the invention.
Figure 7:
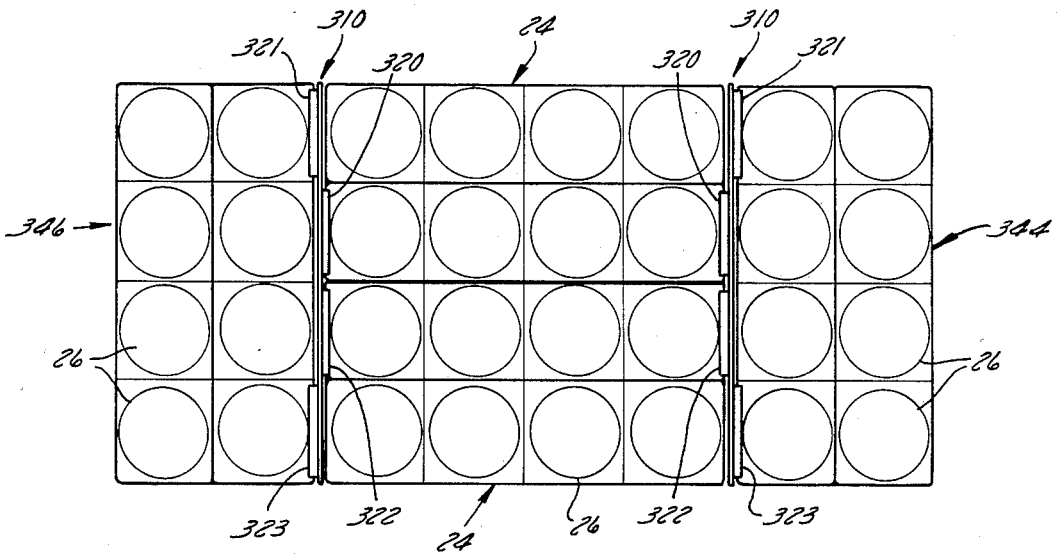
FIG. 7 is a plan view of four cartons on which are mounted two of the devices shown in FIG. 6.
Figure 8:
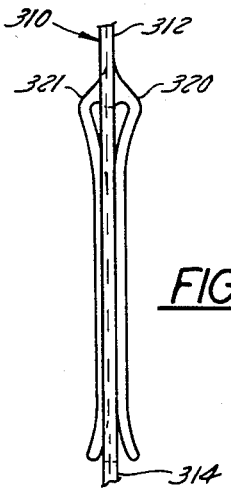
FIG. 8 is a side sectional view partially broken away of the device shown in FIG. 6.

The embodiment of the invention shown in FIGS. 6, 7 and 8 includes four tabs 320, 322, 321, and 323 and may be used to stabilize a single carton, with the tabs 320 and 322 straddling the center panel of the carton, as in the previous embodiments, or it may be used to stabilize several cartons as shown in FIG. 7. In FIG. 7, two of the stabilizers 310 are being used to stabilize four cartons. The central tabs 320, 322 of each stabilizer 310 contact the inner surfaces of the end panels of two inner cartons, and the outer tabs 321, 323 of each stabilizer 310 contact the inner surfaces of a side panel of their respective end carton 344 or 346. FIG. 8 clearly shows the undulated cross section of the tabs 320, 321, which helps retain the stabilizer 310 on the cartons.

While this description has provided the details of several preferred embodiments of the invention, it will be obvious to those skilled in the art that various modifications mat be made to those embodiments without departing from the scope of the present invention.

What is claimed is:

1. A device for stabilizing an open-top carton having a center panel, two side panels, and first and second end panels and resting on a supporting surface, comprising:

a substantially flat member adapted to be installed on one of said end panels so as to support said carton against tipping, wherein the height of said flat member is greater than the height of said end panel, said flat member including:

a. a bottom web portion which is wider than the width of said respective end panel and which is adapted to contact the outer surface of said respective end panel and to rest on said supporting surface when said stabilizing device is installed on said carton;

b. a top web portion which is adapted to lie above said end panel when said stabilizing device is installed on said carton;

c. first and second side web portions which connect said top web portion to said bottom web portion;

d. at least two tabs projecting downward from said top web portion and lying between said first and second side web portions, said tabs being adapted to enter into the open top of said carton so as to contact the inner surface of said end panel of said carton and so as to straddle said center panel.

2. A device for stabilizing an open-top carton having a center panel, two side panels, and first and second end panels and resting on a supporting surface, comprising:

first and second substantially flat members adapted to be installed on said first and second end panels, respectively, so as to support said carton against tipping, wherein the height of said flat members is greater than the height of their respective end panels, each of said flat members including:

a. a top web portion which is adapted to lie above its respective end panel when said stabilizing device is installed on said carton;

b. a bottom web portion which is wider than the width of its respective end panel and which is adapted to contact the outer surface of its respective end panel and to rest on said supporting surface when said stabilizing device is installed on said carton;

c. first and second side web portions which connect said top web portion to said bottom web portion;

d. at least two tabs projecting downward from said top web portion and lying between said first and second side web portions, said tabs being adapted to enter into the open top of said carton so as to contact the inner surface of said respective end panel of said carton and so as to straddle said center panel.

3. A stabilizing device as recited in claim 1 or 2, wherein the width of said bottom web is up to two times the width of said respective end panel.

4. A stabilizing device as recited in claim 3, wherein said flat member is tapered, such that said top web is narrower than said bottom web.

5. A stabilizing device as recited in claim 4, wherein said top web defines a hole adapted for use as a handle.

6. A stabilizing device as recited in claim 4, wherein said tabs are formed so as to be bent out of the plane of said webs to facilitate insertion of said tabs into said carton.

7. A stabilizing device as recited in claim 6, wherein said tabs have an undulated shape for clamping said stabilizing device onto its respective end panel.

8. A stabilizing device as recited in claim 1 or 2, wherein said device includes four of said tabs projecting downward from said top web portion.

9. A carton and stabilizer combination, comprising:

a. a carton having a center panel, two side panels, and first and second end panels adapted to rest on a supporting surface;

b. first and second substantially flat members installed on said first and second end panels, respectively, so as to support said carton against tipping, wherein the height of said flat members is greater than the height of their respective end panels, each of said flat members including:

i. a top web portion which lies above its respective end panel;

ii. a bottom web portion which is wider than the width of its respective end panel and which contacts the outer surface of its respective end panel and rests on said supporting surface when said carton rests on said supporting surface;

iii. first and second side web portions which connect said top web portion to said bottom web portion;

iv. at least two tabs projecting downward from said top web portion and lying between said first and second side web portions, said tabs entering into the open top of said carton, contacting the inner surface of said respective end panel of said carton, and straddling said center panel.

* * * * *